US005795432A

United States Patent [19]

Urban

[11] Patent Number: 5,795,432

[45] Date of Patent: Aug. 18, 1998

[54] COILING MACHINE WITH ADHESIVE STRIP APPLICATOR

[75] Inventor: Ernst-Günther Urban, Neuss, Germany

[73] Assignee: Jagenberg Aktiengesellschaft, Dusseldorf, Germany

[21] Appl. No.: 139,616

[22] Filed: Oct. 18, 1993

Related U.S. Application Data

[63] Continuation of Ser. No. 882,147, May 11, 1992, abandoned.

[30] Foreign Application Priority Data

May 10, 1991 [DE] Germany ..... 41 15 406.1

[51] Int. Cl.[6] ..... B65C 3/12; B65C 3/16; B65C 9/04

[52] U.S. Cl. ..... 156/446; 156/519; 156/522; 156/523; 242/527; 242/527.6; 242/532.3

[58] Field of Search ..... 156/184, 187, 156/446, 510, 519, 522, 523, 526, 574; 242/56 B, 56 R, 56.2, 66, 527, 527.6, 532.3

[56] References Cited

U.S. PATENT DOCUMENTS

| | | | |
|---|---|---|---|
| 3,784,122 | 1/1974 | Kataoka | 242/56 A |
| 3,939,034 | 2/1976 | Tanaka et al. | 156/522 |
| 3,988,192 | 10/1976 | Landis et al. | 156/267 |
| 4,133,495 | 1/1979 | Dowd | 242/66 |
| 4,163,180 | 7/1979 | Dowd | 318/6 |
| 4,422,588 | 12/1983 | Nowisch | 242/56.3 |
| 4,636,276 | 1/1987 | Nozaka | 156/353 |
| 4,684,433 | 8/1987 | Gohr | 156/517 |
| 4,775,110 | 10/1988 | Welp et al. | 242/56.8 |
| 4,783,018 | 11/1988 | Rodriguez | 242/56 R |

FOREIGN PATENT DOCUMENTS 36 11 895 A1 of 0000 Germany .

*Primary Examiner*—David A. Simmons
*Assistant Examiner*—Paul M. Rivard
*Attorney, Agent, or Firm*—Herbert Dubno; Andrew Wilford

[57] ABSTRACT

A winding machine has a carriage movable along the support drum or roller for applying adhesive tape strip to the web wound on rolls on opposite sides of the support roller upon application of a pressing roller on the carriage thereagainst, a cutter wheel severing the web into leading and trailing ends and simultaneously cutting the adhesive strip in two to leave strip segments on the leading and trailing ends.

10 Claims, 3 Drawing Sheets

COILING MACHINE WITH ADHESIVE STRIP APPLICATOR

CROSS REFERENCE TO RELATED APPLICATIONS

This application is a file-wrapper continuation of application Ser. No. 07/882,147 filed 11 May 1992, now abandoned, with a claim to the priority of German patent application P 41 15 406.1 itself filed 10 May 1991.

1. Field of the Invention

My present invention relates to a coiling machine for the coiling of webs of a flexible material on winding sleeves, especially for producing paper or cardboard or paperboard rolls. More particularly, the invention relates to a winding of a web on at least one winding sleeve whereby an adhesive strip is applied to the web to enable it to be secured to the sleeve.

2. Background of the Invention

A winding machine for the winding of one or more bands or strips of paper, paperboard or cardboard on one or more winding sleeves or cores can have a support roller about which the web is guided over at least an arc of the circumference thereof, at least one station at which a sleeve is supported adjacent the periphery of the support roller for winding the web onto the sleeve to form a roll which is supported by the periphery of the support roller, and an applicator for applying an adhesive to the web. Upon cutting of the web, adhesive can be present on both the trailing end which can be bonded to the final turn of the finished roll and on the leading end to be bonded to another sleeve for the commencement of roll winding thereon.

Since the application of the adhesive strip is effected during standstill of the machine, it is a concern that the period or interval of standstill be minimized during roll replacement and, therefore, the steps of slitting the adhesive strip and transversely cutting the web.

Reference is made to German patent document DE-OS 36 11 895 which discloses a prior art winding machine of the aforedescribed type in which the cutting device is formed by a cutter which can be swung toward and away from the support roller and can be displaced parallel to the support roller to separate the leading and trailing ends of the web.

In this system, adhesive traces are applied to the leading and trailing web ends by a row of adhesive spray nozzles above and below the web.

The arrangement of glue-dispensing nozzles, the need for supply piping therefor and the need to provide sufficient time for the glue to set and the maintenance requirements for cleaning parts of an apparatus utilizing liquid glue and parts which are contaminated thereby, all make the roll-change process cumbersome and time-consuming and increase the maintenance costs of the system.

OBJECTS OF THE INVENTION

It is therefore the principal object of the present invention to provide a winding machine which is capable of more rapid roll replacement than earlier winding machines, is structurally simpler and is free from the danger of contamination by glue or the like.

Another object of this invention is to provide an improved winding machine for the purposes described which can expedite roll replacement by simplifying the application of adhesive and the cutting of the web to form the leading and trailing ends mentioned previously.

SUMMARY OF THE INVENTION

These objects and others which will become apparent hereinafter are attained, in accordance with the invention, in a winding machine for the winding of a web, especially a paper, paperboard or cardboard web, upon one or more winding sleeves, which comprises:

a support roller;

guide means for feeding a web to be wound to the support roller, the web passing around an arc of the support roller;

at least one winding station for forming a roll by winding the web around a winding sleeve adjacent the support roller, the roll resting against the support roller and receiving the web therefrom, the winding station including means for rotatably supporting the sleeve for winding of the web thereon;

a carriage shiftable across the web and juxtaposed with the arc;

a pressing roller on the carriage for pressing a two-sided adhesive strip carried by a tape spanned over the pressing roller against the web at the arc of the support roller, thereby transferring the strip to the web as the carriage travels across the web; and a cutter on the carriage behind the pressing roller on the carriage in a direction of displacement of the pressing roller across the web for cutting through the web to form a trailing end of a wound roll and a leading end of a web to be applied to another sleeve strip.

When reference is made to the simultaneous winding of the web on a plurality of winding sleeves, it will be understood that the web can be longitudinally slit by appropriate longitudinal cutting means into individual strips, each of which can be wound on a respective winding sleeve. For that purpose, a plurality of winding stations can be provided around the periphery of the support roller, each winding station having an axis about which one or more winding sleeves can be rotatable. At each station, for example, a plurality of sleeves can be mounted for individual rotation about their common axis and the transversely subdivided but longitudinally extending strips can be alternately wound on sleeves of one and the other station, respectively. At each station, the rolls which are wound with the respective strips are pressed against the support roller and grow as they are wound thereagainst so that the axes of the rolls as they are wound recede from the periphery of the support roller generally radially. The carriage may move entirely across the web including the multiplicity of strips.

According to a feature of the invention, the pressing roller is movable against the support roller independently from the movability of the cutting element, e.g. a cutting wheel, thereagainst. This ensures a reliable separation of webs which may have relatively small web widths without the application of the adhesive to edge regions of the support roller which are not covered by the web. The cutting element, for example, can be applied against the support roller even at edge regions beyond the web while the pressing roller is only applied against the support roller and the web in those regions within the longitudinal edges of the web or strip and is retracted from the support roller beyond the lateral edges of the web, thereby preventing the bonding of adhesive to the support roller in the regions in which it is not covered by the web.

According to a feature of the invention, the supply roll for the tape and a take-up roll from the tape from which the adhesive strips have been transferred to the web, are also mounted on the carriage.

Furthermore, the supply roll together with the pressing roll can be mounted on the carriage so as to be movable toward and away from the support roll.

In this case, the entire adhesive-tape dispenser is mounted on the carriage.

Alternatively, the supply roll and the take-up roll are mounted on opposite sides of the path of the web and are fixed in position, only the pressing roller and the cutter being provided on the carriage. The transfer of the two-sided adhesive strip is then effected only by the pressing action of the pressing roller.

According to another feature of the invention, the cutter is constituted by a wheel having a sharp edge along its periphery and spring biased against the support roller. This has been found to effect reliable cutting of the web and the adhesive strip without requiring an excessive cutting force.

The cutting element or wheel can be so mounted on the slide that the cutting line extends substantially midway through the two-sided adhesive strip. In this case, the adhesive strip is simultaneously subdivided to leave segments on the leading and trailing end, the leading end segment being used to apply the oncoming web to a new sleeve while the trailing end segment allows the trailing end to be bonded to the last turn of the wound roll.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
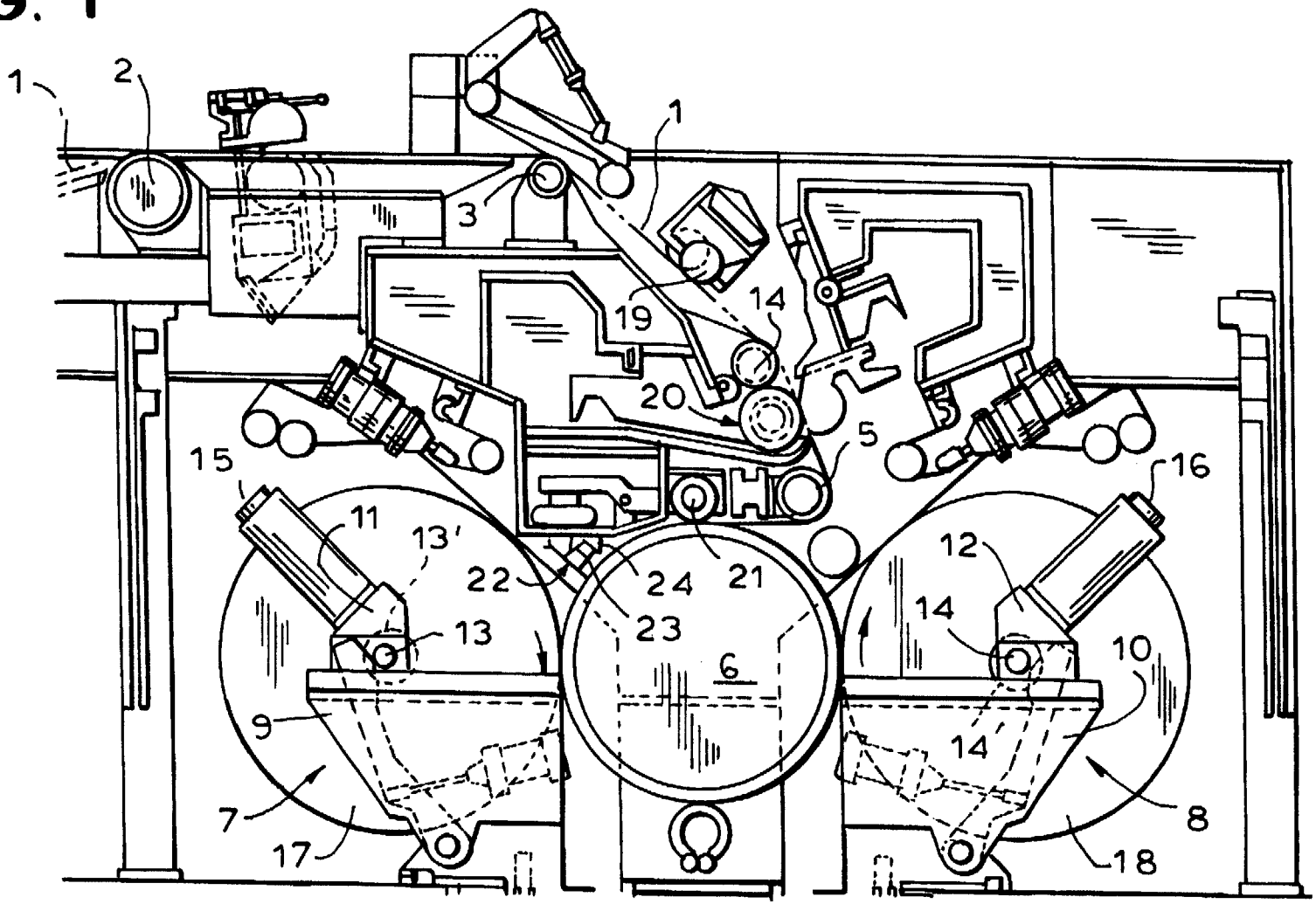
FIG. 1 is a side elevational view of a winding machine according to the invention.
Figure 2:
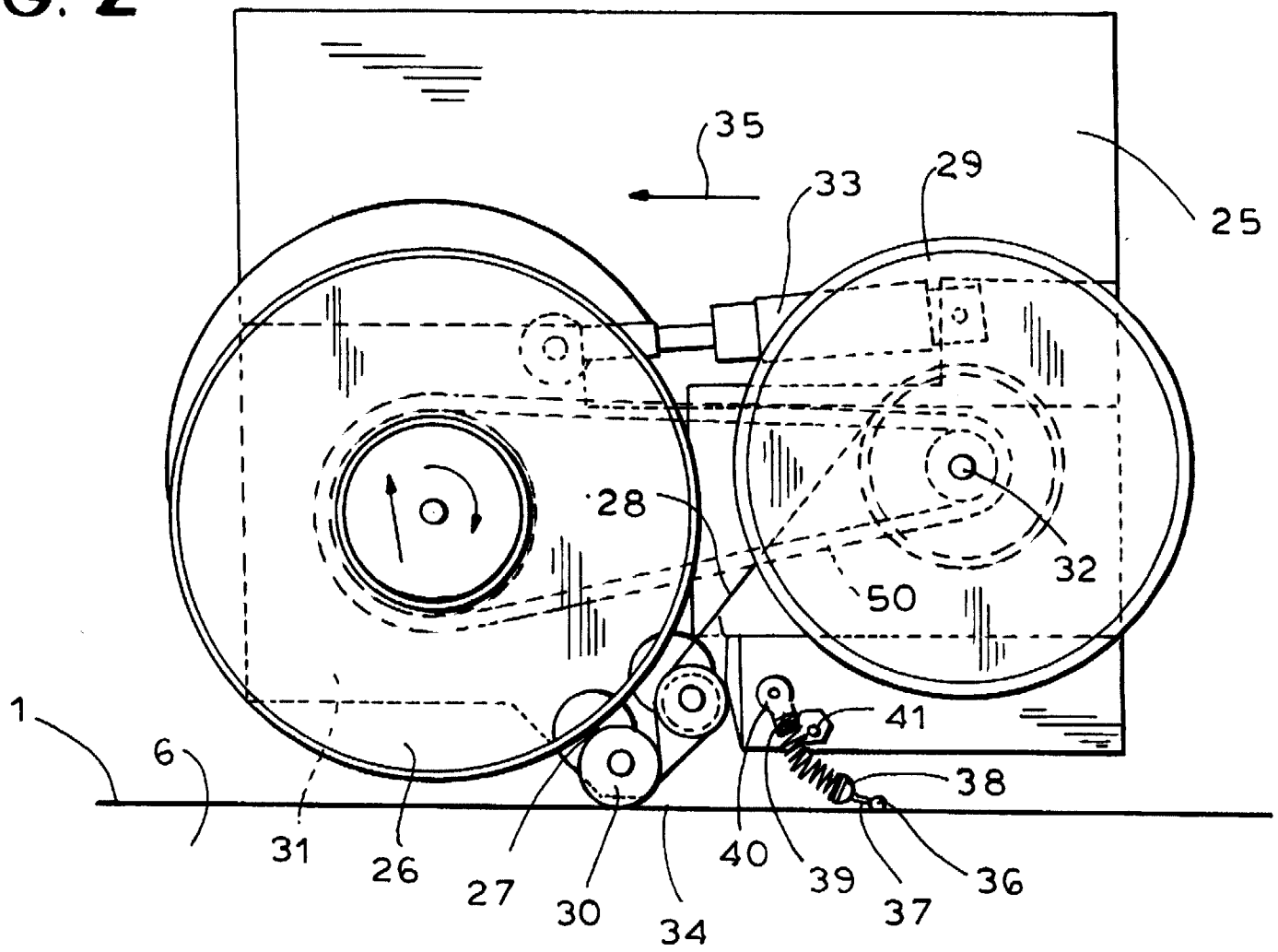
FIG. 2 is a detail view taken in a plane perpendicular to that of FIG. 1 of the carriage and the tape dispenser and cutter according to one embodiment of the invention.

Referring to FIGS. 1 and 2, it can be seen that a web 1 of paper or cardboard, drawn from a supply roll (not shown) can pass over a guide means represented by the guide rollers 2–5 from above onto a driven support roller 6 which may also be referred to as a support drum. As can be seen from FIG. 3, the drum can be perforated and evacuated to retain a web, e.g. of paper, against its periphery.

Juxtaposed with the support roller 6 are two winding stations 7 and 8 disposed on opposite sides of the support roller 6 and each comprising a pair of angle brackets 9, 10 which are shiftable parallel to the support roller axis. Each angle bracket is provided with a carriage 11, 12 shiftable radially with respect to the support roller 6 and carried on the top of this bracket.

Each carriage comprises a drive head 13 or 14 for engaging a respective winding sleeve on which the respective roll 17, 18 can be carried, the sleeves being driven by respective drives 15, 16 which can include electric motors. The sleeves are represented at 13' and 14' in FIG. 1.

Above the support roller 6 is a width-stretching unit 19 which spreads the web in its width direction before it is longitudinally slit by a longitudinal slitting device 20 subdividing the web 1 into a plurality of individual strips which encounter the support roller 6 tangentially and then extend around the periphery of the support roller 6 over an arc thereof. The web is then wound up on the roll 17 or the roll 18 as is conventional in the art. At the station 7, to the left-hand side of the support roller 6, the web passes over an arc of an arc length of about 90° around the periphery of the roller 6. The contact arc length of the web wound upon the roll 18 at station 8 to the right side of the support roller 6 is about 270°. The support roller 6 is evacuated so that, after separation of the web, the trailing ends will be retained against the periphery of the support roller 6 while the newly formed leading ends of the respective strips will be carried to the newly positioned guide sleeves to commence winding of the new roll.

A free-running roller 21 which is pressed against the web at the top of the support roller 6 serves as a tension interrupter for the web as a whole so that the tension in the strips at the individual winding stations 7, 8 can be individually adjusted.

In the region between the roller 21 and the contact line of the roll 17 with the support roller 6, where all of the individual strips of web 1 are still in contact with the periphery of the support roller 6, a device 22 is provided for cutting the web 1 and for applying a double-sided adhesive strip from a tape to the web.

The device 22 comprises a slide or carriage 23 which can be swung against the support roller 6 and shifted linearly over the entire width of the web.

In the embodiment of FIGS. 1 and 2, the slide or carriage 23 carries an adhesive-tape dispenser for an adhesive tape which has one adhesive side bonded to a carrier tape or layer and another adhesive side adapted to bond to the web.

The slide or carriage 23 also carries a cutting element for severing the web as will be described in greater detail.

The slide 23 can be shifted transversely to the longitudinal direction of the web over the entire machine width in a U-shaped carrier or track 24 with a piston-and-cylinder unit connected to the slider at one side of the machine. This piston-and-cylinder unit (not shown) serves to shift the slider back and forth across the web.

The slider or carriage is shown in greater detail in FIG. 2.

The slider or carriage 23 has a pair of side plates 25 extending in planes perpendicular to the travel direction of the web and displaceable in respective radial planes of the support roller 6. Between these plates, the adhesive-tape dispenser is received.

The adhesive-tape dispenser comprises a supply roll 26 for the adhesive tape 27 which, in turn, includes a carrier or support tape 28 and an adhesive strip 34 which is double-sided, i.e. has pressure or contact adhesive on both of its surfaces.

A spool 29 serves to wind up the spent carrier 28, i.e. the support tape from which the double-sided adhesive has been transferred to the web.

Between the supply roll 26 and the take-up spool 29, a free-running pressing roller 30 is provided which can be mounted with the supply roll 26 so as to be movable toward and away from the support roller 6 and thus can be pressed against the support roller.

For this purpose, the supply roll 26 and the pressing roller 30 are mounted on a lever 31 which is swingable about an axis 32 of the take-up spool 29 by a piston-and-cylinder unit 33.

The pressing roller 30 around which the adhesive tape 27 is looped can thus be pressed against the web and the support roller 6 to apply the adhesive strip thereto and can be retracted from this web beyond the edges thereof so that the adhesive strip is applied only to the web.

Rearwardly of the pressing roller 30 on the carriage or slider and in the direction of movement thereof for application of the strip 34 (arrow 35), there is provided a cutter which can be in the form of a wheel 36 composed of hard metal or a hardened tool steel and having a sharp cutting edge on its periphery, the wheel 36 being freely rotatable in a fork-shaped extension of a pin 37.

The other end of the pin 37 is keyed in a coil spring 38 fastened on a short lever 39 articulated on the plate 25 by means of a screw 40.

The angle of attack of the lever 39 against the support roller 6 and thus the force with which the cutting wheel 36 is urged thereagainst can be adjusted with an eccentric stop 41. The cutting wheel 36 is so mounted on the plate 25 that its cutting line passes exactly along the center of the applied strip 34.

For roll replacement, the winding machine is brought to standstill, i.e. the support roller 6 is stopped. Suction is produced in the support roller 6 to hold the web 1 against the periphery thereof. The slider or carriage 23 at one side of the machine is pressed against the support roller 6 so that the cutter wheel 36 is in position to slice through the adhesive strip and the web. The slide 23 is then moved across the web along the support roller 6 until the pressing roller 30 passes over the edge of the web 1. That roller is then pressed against the web and the support roller 6 to apply the adhesive strip 34 thereto.

Movement of the slider is continued along the web to apply the strip and simultaneously cut through the strip and the web in the manner described while the spent tape 38 is wound up on the spool 29. The spent spool and supply roll 26 are so coupled by a mechanism represented only at 50 that the tape is held under tension around the roller 30.

When the slide 23 reaches the opposite side of the machine, the roller 30 is lifted at the opposite longitudinal edge of the web away from the latter while the movement of the slider continues to fully cut through the web. The leading and trailing ends of the web thus formed are provided with adhesive strips so that upon further rotation of the support roller 6 and drive of the machine, the trailing end will bond to the last turn of a finished roll and the leading end will bond to the new sleeve disposed in position once the finished roll has been replaced by the new sleeve.

Figure 3:
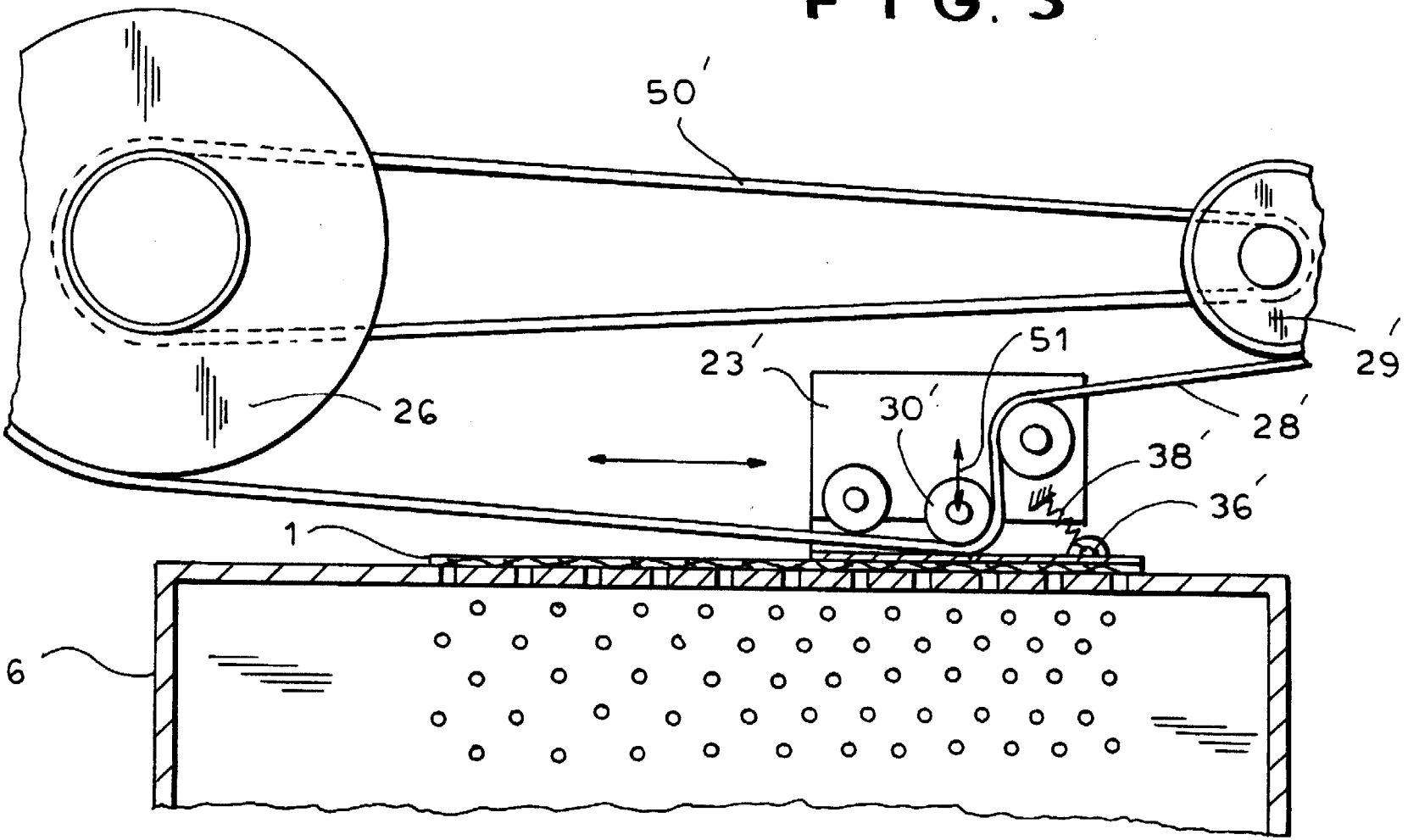
FIG. 3 is a view similar to FIG. 2 but showing the carriage in the case where both the supply roll of the adhesive tape and the take-up roll for the backing strip thereof are disposed on opposite sides of the machine.

In FIG. 3 I have shown an alternative construction in which the supply roll 26' and the spool 29' to take up the spent tape support strip 28' are fixedly mounted on opposite sides of the machine and coupled by a synchronizing drive 50'. The carriage 23' thus does not carry the supply roll and take-up spool but does have the applicator roller 30' which is movable perpendicular to the web 1 as represented by the arrow 51. It also carries the cutter wheel 36' which is biased by the spring 38' to cut through the web in the manner previously described. In this case as well, the cutter severs the web and the strip to form leading and trailing ends in the manner described.

I claim:

1. A winding machine for winding a web having a pair of opposite sides on at least one winding sleeve, the winding machine comprising:

a support roller;

guide means for feeding a web to be wound to the support roller, the web passing around an arc of the support roller, the support roller facing one of the sides of the web;

at least one winding station for forming a roll by winding the web around a winding sleeve adjacent the support roller, the roll resting against the support roller and receiving the web therefrom;

means at the winding station for rotatably supporting the sleeve for rotation about an axis;

a carriage facing the other side of the web and shiftable axially across the web and directly juxtaposed with the support roller at the arc;

means including a pressing roller on the carriage for pressing a two-sided adhesive strip carried by a tape spanned over the pressing roller against the other side of the web at the arc of the support roller and thereby transferring the strip to the other side of the web against the support roller;

means for displacing the carriage axially across the web; and a cutter on the carriage behind the pressing roller and juxtaposed with the other side of the web on the carriage in an axial direction of displacement of the pressing roller across the web for cutting through the web and through the strip by engagement of the cutter through the web and strip as the carriage travels and against the support roller to form a trailing end of a wound roll and a leading end of a web to be applied to another sleeve strip, whereby each end is left carrying a portion of the strip.

2. The machine defined in claim 1 wherein the pressing roller is mounted for movement toward and away from the support roller independently of the cutter.

3. The machine defined in claim 1 wherein the dispenser includes a supply roll mounted on the carriage and a take-up spool mounted on the carriage for taking up a support for the strip and from which the strip is transferred to the web.

4. The machine defined in claim 3 wherein the supply roll and the pressing roller are mounted for joint movement toward and away form the support roller on the carriage.

5. The machine defined in claim 1 wherein the tape is fed from a supply roll fixedly disposed at one side of the machine and a spent support take is wound up at an opposite side of the machine.

6. The machine defined in claim 1 wherein the cutter is a wheel having a sharp edge along its periphery and is spring biased against the support roller.

7. The machine defined in claim 1 wherein the cutter is so mounted on the carriage that a cut line through the web passes substantially midway through the strip.

8. A machine for winding a web having a pair of opposite sides onto at least one winding sleeve, the winding machine comprising:

a support roller rotatable about and centered on a roller axis;

guide means for feeding a web to be wound to the support roller with the one side of web engaging the roller along a contact arc of the support roller;

means for supporting the winding sleeve in radial engagement with the roller;

drive means for rotating the roller and sleeve and thereby winding up the web on the sleeve;

a supply of a tape bearing a two-sided adhesive strip;

a carriage facing the other side of the web and shiftable axially across the web at the arc;

a pressing roller on the carriage over which is spanned the two-sided adhesive strip carried by the tape;

biasing means for urging the pressing roller and the strip against the other side of the web at the arc of the support roller;

means for displacing the carriage axially across the web and thereby transferring the strip to the other side of the web against the support roller; and a cutter on the carriage axially behind the pressing roller and juxtaposed with the other side of the web on the carriage in an axial direction of displacement of the pressing roller across the web for cutting through the web and through the strip by engagement of the cutter through the web and strip as the carriage travels to form a trailing end of a wound roll and a leading end of a web to be applied to another sleeve, whereby each end is left carrying a portion of the strip.

9. The winding machine defined in claim 8, further comprising means for adhering the one side of the web to the support roller at the arc.

10. The winding machine defined in claim 9 wherein the adhering means includes perforations in the roller and means for aspirating the interior of the roller.

* * * * *